United States Patent [19]

Dueland et al.

[11] Patent Number: 4,782,270

[45] Date of Patent: Nov. 1, 1988

[54] CRT RASTER REVERSAL BOARD

[75] Inventors: Karl E. Dueland, Lansing; Michael D. Givens, Spencer, both of N.Y.

[73] Assignee: NCR Corporation, Dayton, Ohio

[21] Appl. No.: 44,095

[22] Filed: Apr. 30, 1987

[51] Int. Cl.[4] ..... H01J 29/70; G09G 1/06

[52] U.S. Cl. ..... 315/399; 340/735

[58] Field of Search ..... 315/399, 368; 358/237; 340/735, 727

[56] References Cited

U.S. PATENT DOCUMENTS

| | | | |
|---|---|---|---|
| 4,183,063 | 1/1980 | Lewis | 358/237 |
| 4,262,291 | 4/1981 | Zammit et al. | 340/756 |
| 4,581,611 | 4/1986 | Yang et al. | 340/750 |

*Primary Examiner*—Theodore M. Blum
*Assistant Examiner*—Gregory C. Issing
*Attorney, Agent, or Firm*—Wilbert Hawk, Jr.; Albert L. Sessler, Jr.; George J. Muckenthaler

[57] ABSTRACT

A system for reversing directions of character displays in a CRT which includes apparatus for generating font signals, disconnecting the supply voltage, reversing the horizontal deflection coil polarity, and reconnecting the supply voltage.

5 Claims, 6 Drawing Sheets

| FIG. 2A | FIG. 2B |
|---|---|
| FIG. 2C | |

CRT RASTER REVERSAL BOARD

BACKGROUND OF THE INVENTION

In the field of cathode ray tubes which are utilized for providing a visual display of text material, it is generally known that some languages are displayed in one direction across the screen of the tube and that other languages are displayed in the other direction. Specifically, in the case of English and like European languages, the raster scan normally goes from left to right on the screen whereas in the case of Arabic and like languages, the raster scan normally goes from right to left on the screen.

The Arabic language includes the system of numerals and symbols currently used in Arabic speaking countries as contrasted with other systems of numerals and symbols currently in use in English speaking countries.

Representative documentation in the area of display systems includes U.S. Pat. No. 4,262,291, issued to C. C. Zammit et al. on Apr. 14, 1981, which discloses an Arabic numeral display and illustrating the correlation between Arabic and European numerals.

U.S. Pat. No. 4,581,611, issued to C. C. Yang et al. on Apr. 8, 1986, discloses a character display system having a video inhibit signal generated for a period of time to avoid or prevent flashing on the screen during refreshing thereof.

SUMMARY OF THE INVENTION

The present invention relates to cathode ray tubes and to a system for reversing directions of character displays on the screen. The invention includes a method for switching directions of character displays in a CRT terminal. While previous methods for switching directions have employed software, the present invention utilizes hardware. The raster scan for English language characters is displayed in left to right direction and the raster scan for Arabic language characters is displayed in right to left direction.

When it is desired to change the direction of the raster scan, a FONT signal changes state and a DELTA FONT signal is generated through use of hardware. The hardware provides means for latching the DELTA FONT signal through a flip-flop device and a relay is opened to disconnect the supply voltage to the CRT driver board. A counter is enabled to trigger a double throw relay which reverses the directions of the horizontal deflection coils. The counter then generates another signal which resets the flip-flop, the relay is closed, and the supply voltage is reconnected to the CRT driver board to effect a reversal in direction of the raster scan.

In accordance with the above discussion, a principal object of the present invention is to provide hardware means for reversing the direction of character displays on a CRT screen.

Another object of the present invention is to provide a CRT display system which can more simply accommodate different languages.

An additional object of the present invention is to provide a CRT display system which uses switching and relay means for reversing the supply voltage connections to the horizontal deflection coils.

A further object of the present invention is to provide timing means for triggering double pole, double throw relay means to reverse the connections of the horizontal deflection coils of the CRT.

Additional advantages and features of the present invention will become apparent and fully understood from a reading of the following description taken together with the annexed drawing.

DESCRIPTION OF THE PREFERRED EMBODIMENT

Figure 1:
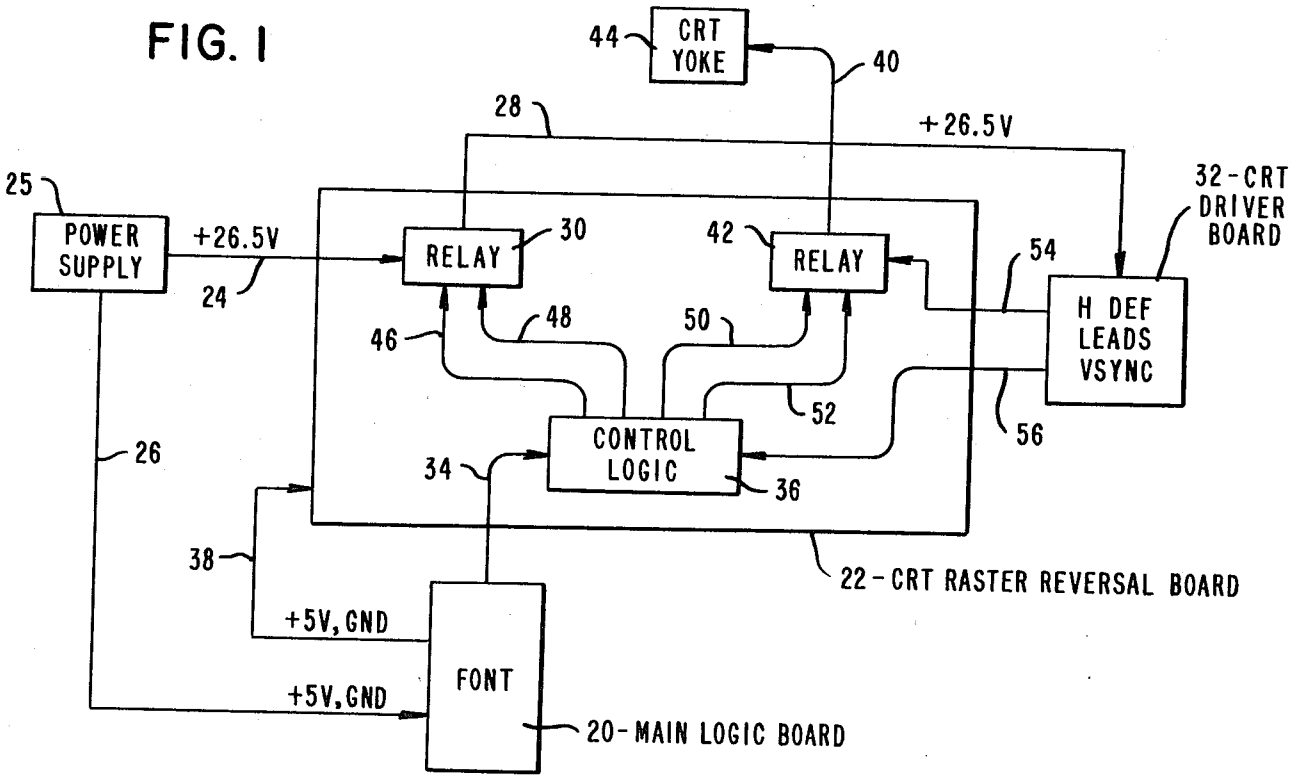
FIG. 1 is a block diagram illustrating the diagrammatic structure of the system.

Referring now to the drawing, FIG. 1 is a block diagram of the essential components of the system which include a main logic board 20 and a raster reversal board 22. A power supply 25 of 26.5 volts, or any other suitable power supply voltage, is connected by lead 24 to the raster reversal board 22. A cable 26 containing a five volt supply line and a ground return line is connected to the power supply 25 and to the main logic board 20. A 26.5 volt line 28 is coupled from a relay 30 to a CRT driver board 32. The main logic board 20 is connected by a lead 34 to a control logic panel 36, and a cable 38 containing a five volt supply line and a ground return line couples the main logic board 20 to the raster reversal board 22. A lead 40 connects a relay 42 on the raster reversal board 22 to a CRT yoke 44. The control logic panel 36 is coupled by leads 46 and 48 to the relay 30 and the panel 36 is coupled by leads 50 and 52 to the relay 42. The CRT driver board 32 is connected to the relay 42 by cable 54 and the driver board 32 is connected to the control logic panel 36 by cable 56.

Figures 2, 2C:
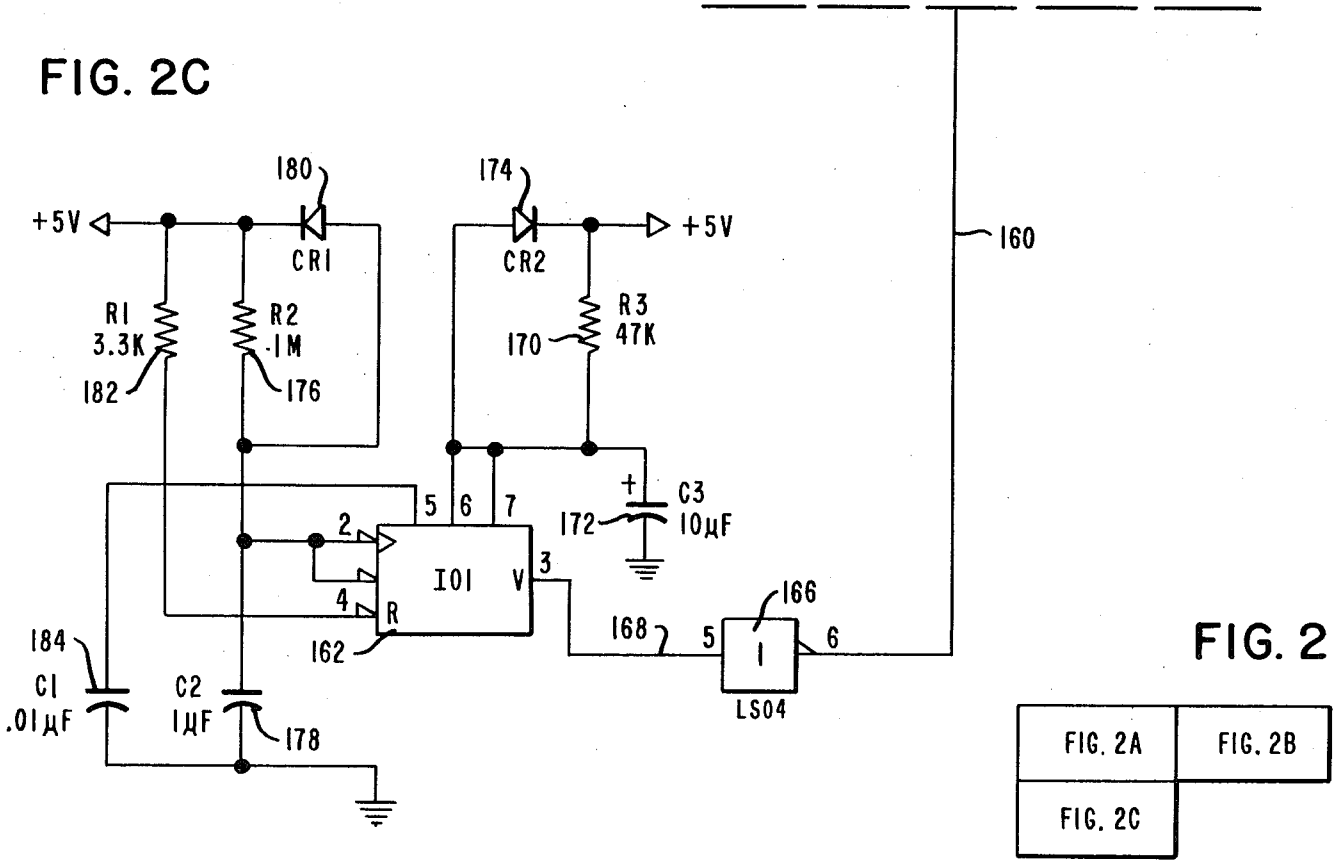
FIG. 2 illustrates the manner of orientation of FIGS. 2A, 2B and 2C.
FIGS. 2A, 2B and 2C taken together constitute a logic diagram of the components of the system.
Figure 2A:
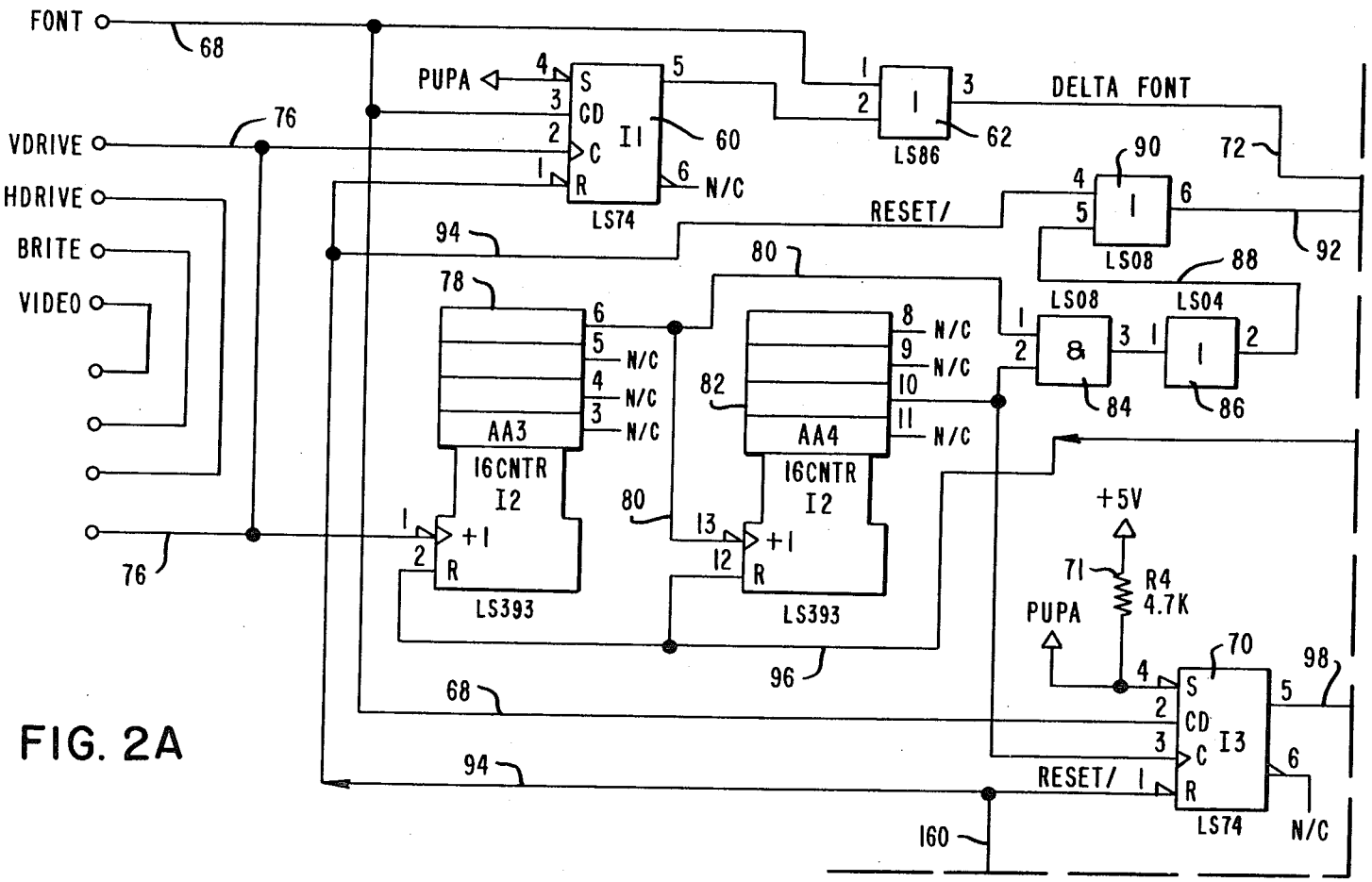
Figure 2B:
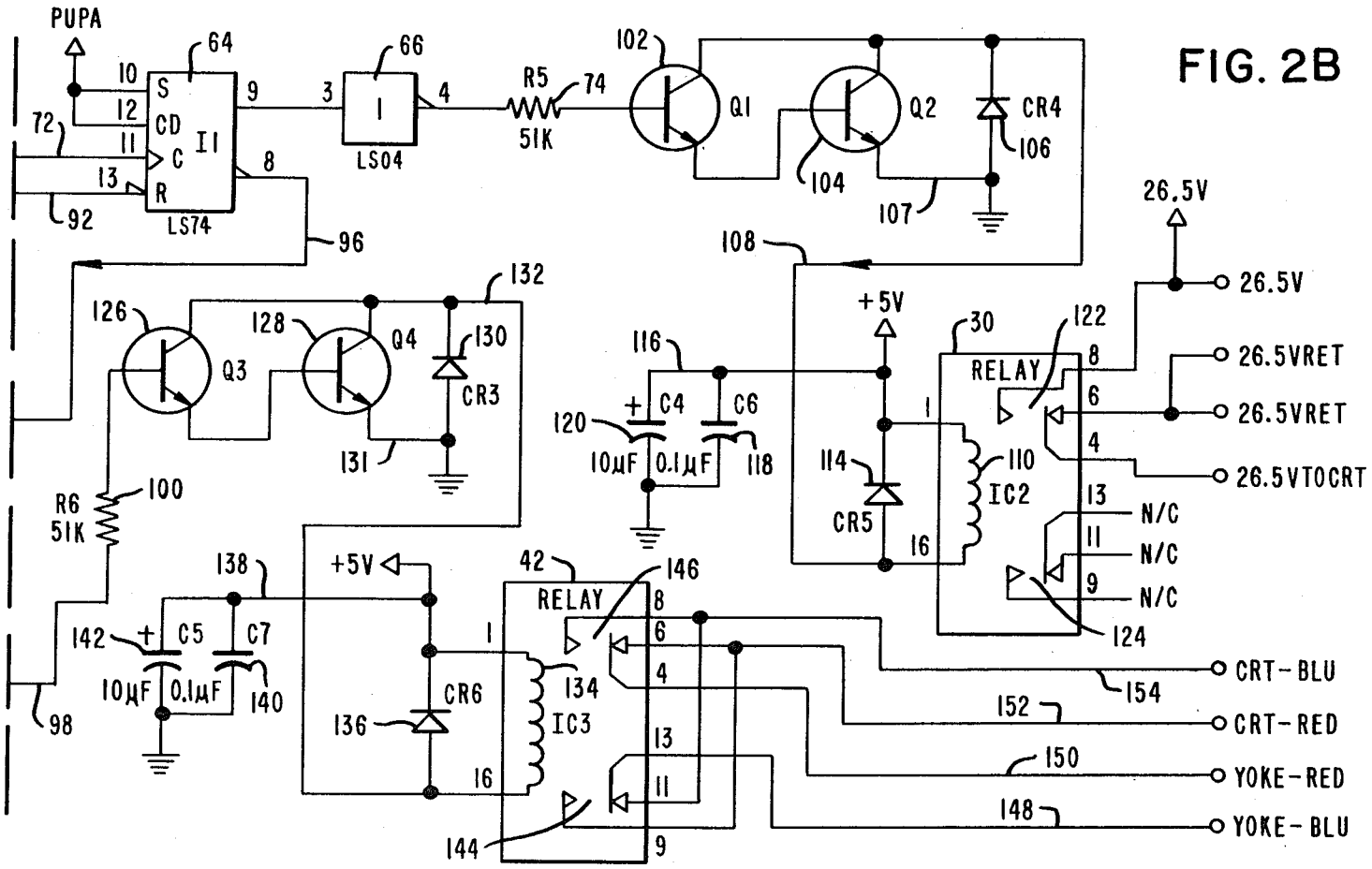

FIGS. 2A, 2B and 2C illustrate the logic diagram utilized in the present invention. The circuitry includes a dual D-type positive-edge-triggered flip-flop 60 with preset and clear features, which flip-flop is coupled to a quadruple 2-input exclusive OR gate 62 (FIG. 2A), in turn connected with a dual D-type flip-flop 64 which is coupled to a hex inverter 66 (FIG. 2B).

A FONT signal 68 provides an input for the exclusive OR gate 62 and the signal 68 is coupled to the flip-flop 60 and to a similar flip-flop 70 (FIG. 2A). The output of exclusive OR gate 62 provides a DELTA FONT signal over line 72 to the flip-flop 64 (FIG. 2B). The output of inverter 66 is directed through a 51K resistor 74 and then to a pair of transistor drivers 102 and 104 which will be described later. A supply of five volts is provided through a 4.7K resistor 71 to the flip-flop 70 (FIG. 2A).

A vertical drive signal is provided over line 76 to the flip-flop 60 and to a dual 4-bit decode and binary counter 78 (FIG. 2A), an output thereof being coupled over line 80 to a similar counter 82 and to a quadruple 2-input positive AND gate 84. The vertical drive signal 76 is the clock signal for the reverse raster board 22. All timing values are dependent on the frequency of the vertical drive signal 76 and the hardware is provided and set up under the assumption that the vertical drive signal is 80 Hz. The output of the AND gate 84 is coupled to a hex inverter 86, the output being connected as one input over line 88 to a 2-input positive AND gate 90. The output of AND gate 90 is coupled over lead 92 to the flip-flop 64 (FIG. 2B). A lead 94 couples the flip-flop 60 with the flip-flop 70 and provides the second input to the AND gate 90 (FIG. 2A). A lead 96 couples the flip-flop 64 to the counters 78 and 82. The flip-flop 70 is coupled over line 98 through a 51K resistor 100 and then to a pair of transistor drivers 126 and 128 (FIG. 2B) which will be described later.

A pair of Darlington type transistor drivers 102 and 104 (FIG. 2B) are coupled together with a diode 106. A common lead 108 is coupled to the collectors of the transistors 102 and 104, to the diode 106, and to one side of a coil 110 of the relay 30 on the board 22 (FIG. 1). The lead 108 is also connected to one side of a diode 114 (FIG. 2B), the other side of the diode being coupled by a common lead 116 to the other side of the coil 110, to a pair of capacitors 118 and 120 and to a supply of five volts. A lead 107 couples the grounding side of the diode 106 and the emitter of the transistor 104. The relay 30 includes a pair of contact type switches 122 and 124 connected to a supply voltage of 26.5 volts. The relay 30 which is driven by the transistors 102 and 104 operates to disconnect the 26.5 volt supply from the CRT driver board 32 and operates to later reconnect the supply voltage.

In similar manner, a pair of Darlington type transistor drivers 126 and 128 (FIG. 2B) are coupled together with a diode 130. A common lead 132 is coupled to the collectors of the transistors 126 and 128, to the diode 130, and to one side of a coil 134 of the relay 42 on the board 22 (FIG. 1). The lead 132 is also connected to one side of a diode 136 (FIG. 2B), the other side of the diode being coupled by a common lead 138 to the other side of the coil 134, to a pair of capacitors 140 and 142 and to a supply of five volts. A lead 131 couples the grounding side of the diode 130 and the emitter of the transistor 128. The relay 42 includes a pair of contact type switches 144 and 146 connected by individual leads 148, 150, 152 and 154 of cable 40 (FIG. 1) to the CRT yoke 44. The relay 42 which is driven by the transistors 126 and 128 operates to reverse the leads to the coil 134 of relay 42 and thereby to the CRT yoke 44. It should be noted from FIG. 1 that the cable 54 contains wiring to connect with the horizontal deflection leads of the CRT driver board 32 and that the cable 56 contains wiring to connect with the vertical signal of the CRT driver board.

FIG. 2C illustrates reset circuitry of a well-known type which is associated with the flip-flops 60 and 70 (FIG. 2A) and includes a lead 160 connected to lead 94 connected as an input to the flip-flops. The reset circuitry includes a timer 162 (FIG. 2C) coupled to a hex inverter 166 by lead 168, the inverter being connected to the lead 160.

The reset circuitry also includes an R-C coupling network having a 47K resistor 170 and a capacitor 172 connected with a diode 174. Another R-C coupling network having a 1M resistor 176 and a capacitor 178 is connected with a diode 180. A 3.3K resistor 182 is coupled to one side of the diode 180 and to the timer 162, and a capacitor 184 is connected to the timer 162 and to ground.

Figure 3:
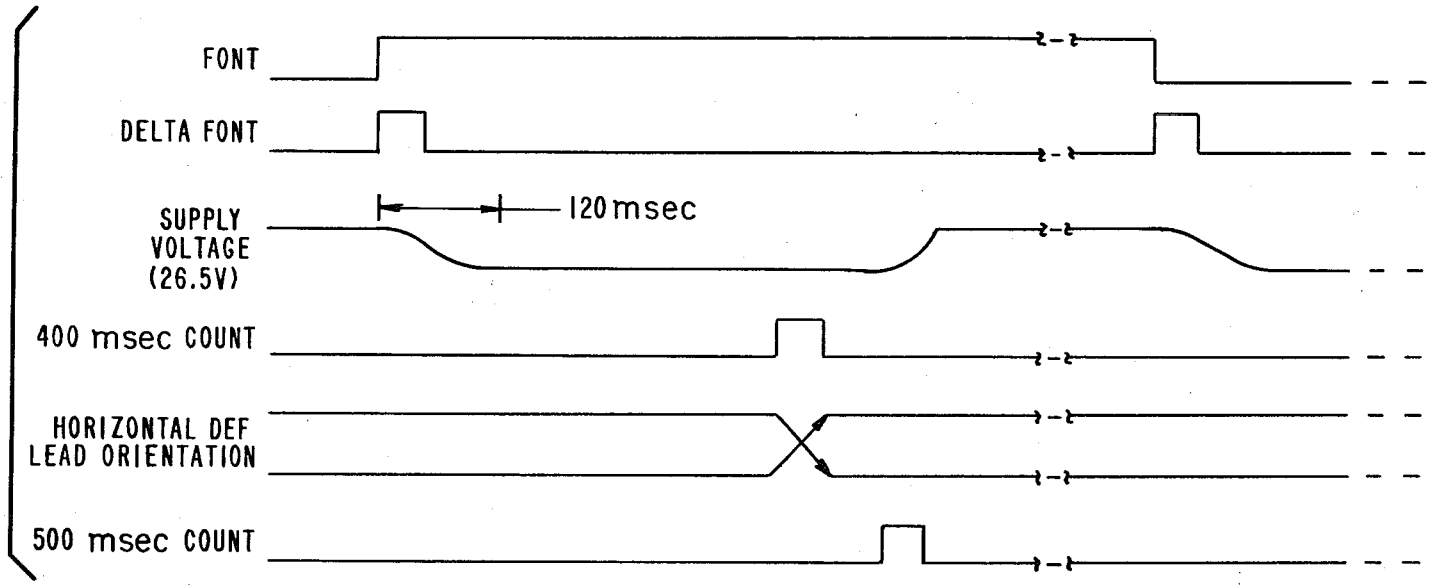
FIG. 3 is a timing diagram showing the various operation timings of the system.

FIG. 3 illustrates the various timing operations of the reversing system wherein a change in state of the FONT signal 68 generates a DELTA FONT signal 72. The DELTA FONT signal 72 is latched through the flip-flop 64 (FIG. 2B) which in turn opens the relay 30 through the transistors 102 and 104, to disconnect the supply voltage of 26.5 volts to the CRT driver board 32 (FIG. 1). This operation enables a bleed-off of the voltage at the horizontal deflection coils of the CRT which voltage bleed-off takes about 120 msec. At the same time that the DELTA FONT signal 72 is generated, the counter 78 (FIG. 2A) is enabled. After a count of 400 msec dependent upon the frequency of the video drive signal 76, a signal from the counter triggers the relay 42 (FIG. 2B) through the transistors 126 and 128 to reverse the connections of the horizontal deflection coils. The counter 78 generates another signal at the 500 msec time from the time that the DELTA FONT signal 72 was generated. This signal resets the flip-flop 64 that is holding the relay 30 in a supply voltage disconnect position. The supply voltage of 26.5 volts is reconnected to the CRT driver board 32 and the raster scan is now oriented in a reverse direction.

Figure 4:
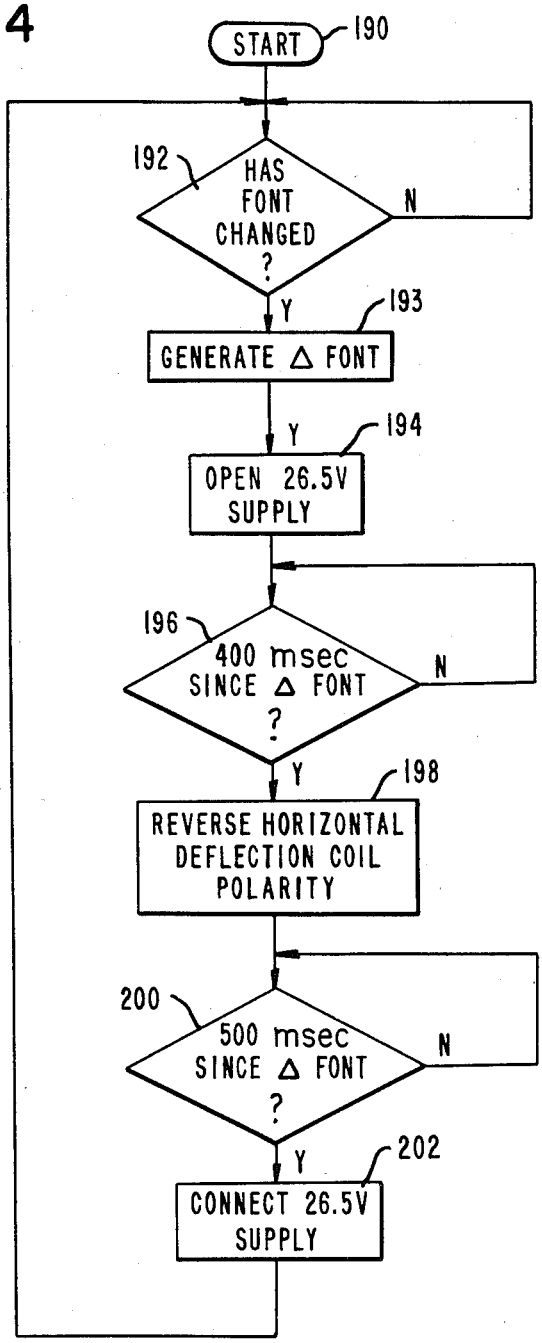
FIG. 4 is a flow diagram of the essential steps of the reversing system.

FIG. 4 is a flow diagram of the various steps in the practice of the invention. The start step 190 indicates a ready condition for the reversal of the raster scan. Step 192 inquires whether or not the FONT signal 68 has changed state. The next step 193 is an indication of whether a DELTA FONT signal 72 has been generated to open the 26.5 volts supply, as at 194. The next step 196 questions whether or not the counter 78 has effected the 400 msec count since the DELTA FONT signal 72 was generated. If true, the next step, as 198, is to reverse the polarity of the horizontal deflection coil at the CRT. The next step 200 questions whether or not the counter 82 has effected the 500 msec count from the time that the DELTA FONT signal 72 was generated. If true, the last step 202, is to reconnect the 26.5 volts supply. The 400 msec and 500 msec times are effective and dependent upon the frequency of the video drive signal 76. When it is desired to return to the original scan direction, the relays 30 and 42 are operated to effect a reversal of the connections of the horizontal deflection coil in the manner as described above.

It is thus seen that herein shown and described is apparatus for reversing the raster scan across the screen of a CRT which apparatus utilizes hardware to effect the reversing operation. The present invention enables the accomplishment of the objects and advantages mentioned above, and while a preferred embodiment of the invention has been disclosed herein, variations thereof may occur to those skilled in the art. It is contemplated that all such variations and modifications not departing from the spirit and scope of the invention hereof are to be construed in accordance with the following claims.

We claim:

1. Apparatus for reversing the raster scan across the screen of a CRT terminal having a horizontal deflection coil and coupled to a source of supply voltage, said apparatus comprising means comprising a clock generator for generating a signal indicative of the font appearing on the screen of the CRT terminal, means comprising a flip-flop for latching the signal for a period of time to allow bleed-off of the supply voltage across the horizontal deflection coil of the CRT terminal, a first counter, means comprising a vertical drive signal for enabling said first counter for a period of time beyond the time for bleed-off of the supply voltage, means comprising a first relay coupled to said flip-flop to disconnect the supply voltage, means comprising a second relay to reverse the leads connected to the horizontal deflection coil, a second counter, means coupled to said first counter for enabling the second counter to continue for a period of time after actuating the second relay, and means for generating a signal at the end of the period of time after actuating the second relay for resetting the latched signal to enable reconnection of the leads to the horizontal deflection coil of the CRT terminal and thereby reverse the direction of raster scan across the screen of the CRT terminal.

2. The apparatus of claim 1 wherein the generating means comprises a clock signal.

3. The apparatus of claim 1 wherein the means for latching the signal comprises a flip-flop.

4. The apparatus of claim 1 wherein the means for actuating the relay comprises a pair of transistors.

5. The apparatus of claim 4 including a diode coupled to the transistors and connected to the horizontal deflection coil.

* * * * *